US005681067A

United States Patent [19]

MacIntyre

[11] Patent Number: 5,681,067

[45] Date of Patent: Oct. 28, 1997

[54] PLUNGER ARRANGEMENT FOR RETAINING GLASS/SCREEN INSERTS IN FRAMES

[75] Inventor: Robert James MacIntyre, Oconomowoc, Wis.

[73] Assignee: Metal Industries, Inc., Elizabethville, Pa.

[21] Appl. No.: 589,484

[22] Filed: Jan. 22, 1996

[51] Int. Cl.[6] ..... E05C 1/08

[52] U.S. Cl. ..... 292/163; 292/175

[58] Field of Search ..... 292/163, 175

[56] References Cited

U.S. PATENT DOCUMENTS

| | | | |
|---|---|---|---|
| 8,286 | 8/1851 | Bush | 292/175 |
| 595,290 | 12/1897 | Dowan | 292/150 |
| 1,509,619 | 9/1924 | Talbert | 292/173 |
| 1,892,613 | 12/1932 | Edgin | 292/304 |
| 2,029,199 | 1/1936 | Segar | 292/163 |
| 2,041,684 | 5/1936 | Anderson | 292/163 |
| 3,233,932 | 2/1966 | Utterback | 292/175 |
| 3,837,118 | 9/1974 | Goss, Jr. et al. | 49/61 |
| 4,270,779 | 6/1981 | Watts | 292/175 |
| 5,368,346 | 11/1994 | Foster | 292/175 |

*Primary Examiner*—Steven M. Meyers
*Assistant Examiner*—Stephen J. Pentlicki
*Attorney, Agent, or Firm*—Lawrence G. Fridman; Anthony F. Cuoco

[57] ABSTRACT

Plunger arrangements are used for retaining glass/screen inserts in frames. A plurality of caps are disposed around the insert and are disposed in one position for extending a spring biased plunger to engage the frame. The caps are disposed in an other position against the spring bias to retract the plunger from the frame. The arrangement is such that the cap remains in the other position without being held thereat by a user, whereby the user's hands are free to manipulate the insert in or out of the frame.

6 Claims, 2 Drawing Sheets

PLUNGER ARRANGEMENT FOR RETAINING GLASS/SCREEN INSERTS IN FRAMES

BACKGROUND OF THE INVENTION

It is desirable to have screen or glass window or door inserts interchangeably or replaceably retained in the window or door frame. One way of accomplishing this is to use plunger arrangements which are supported by the insert and engage the frame. As many of these plunger arrangements as desired may be disposed around the perimeter of the insert to securely retain the insert in the frame.

It is desirable that the plunger arrangements be as simple as possible, both in construction and operation, so that the screen and/or glass inserts can be easily interchanged or replaced, as the case may be. The present invention accomplishes this as will be discerned from the description of the invention which follows.

SUMMARY OF THE INVENTION

This invention contemplates a plunger arrangement for retaining glass/screen inserts in frames, wherein a plurality of caps are disposed around the perimeter of an insert. Each of the caps retains a plunger assembly including a spring biased plunger. When the caps are in one position, the plunger is retracted so as to be disengaged from the frame. When the cap is flipped from the one position to an other position, the plunger is extended for engaging the frame. When the cap is in the other position, it is retained in said position without being held thereat by a user. That is to say, the plunger of the invention retracts when the plunger cap is flipped to the other position and remains retracted via its structural configuration when the plunger cap is released. This is in contrast to prior art plunger assemblies for the purposes described, wherein the caps must be manually displaced away from the insert and held so displaced to maintain the plunger disengaged from the frame hole.

DETAILED DESCRIPTION OF THE INVENTION

Figure 1:
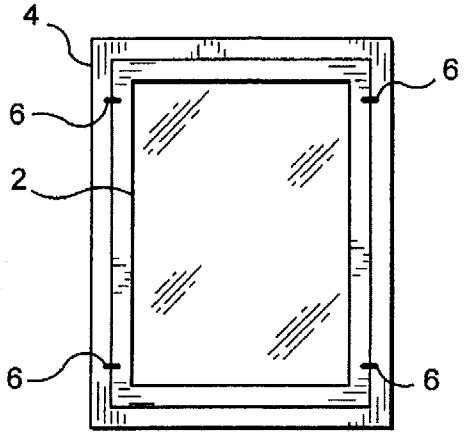
FIG. 1 is a diagrammatic representation illustrating a frame and an insert which is retained by the frame according to the present invention.

With reference to FIG. 1, a window or door frame is designated by the numeral 4. A screen or glass insert 2 fits into frame 4. Frame 4 and insert 2 are substantially rectangular in shape as is well known in the art. Insert 2 is removable from frame 4 so that a glass insert may be interchanged by a screen insert or vice versa, or the glass or screen insert may be replaced, as the case may be.

Insert 2 is maintained in frame 4 by a plurality of plunger assemblies 6 disposed around the perimeter of the insert.

Figure 2:
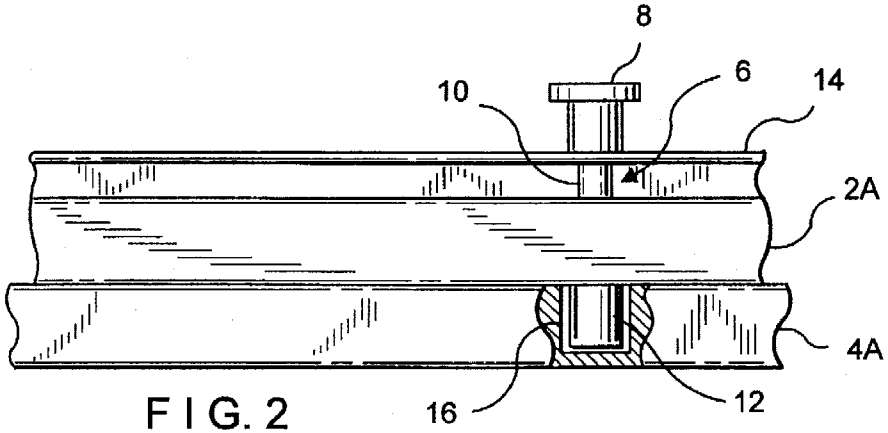
FIG. 2 PRIOR ART
FIGS. 2–4 are diagrammatic representations illustrating a prior art plunger arrangement for retaining glass/screen inserts in frames in accordance with the prior art.
Figure 3:
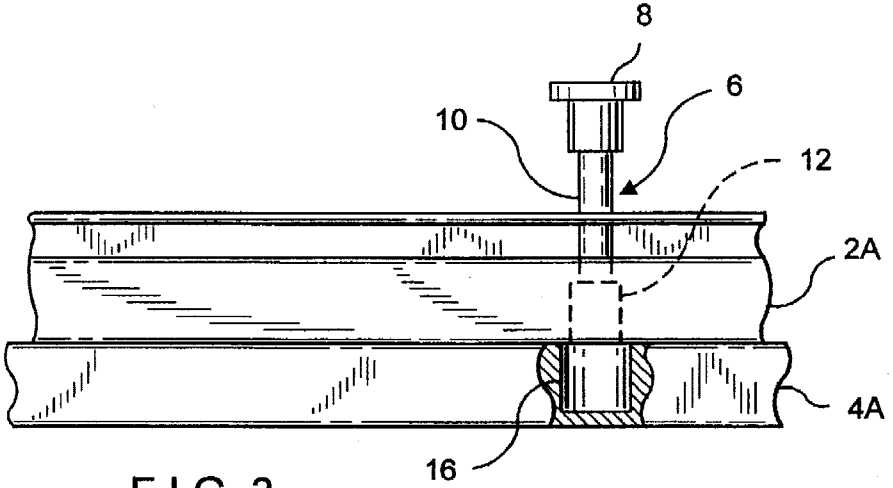
FIG. 3 PRIOR ART
Figure 4:
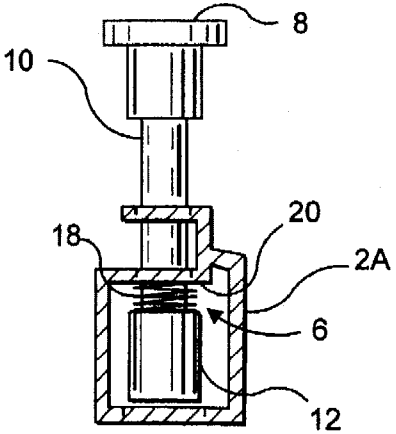
FIG. 4 PRIOR ART

With reference to FIGS. 2–4, each plunger assembly 6 includes an integral cap 8, stem 10, and plunger 12, and a biasing spring 18 surrounding stem 10. For purposes of illustration, a single plunger assembly 6 is shown in relation to an insert member 2A and a corresponding frame member 4A.

FIG. 2 shows plunger assembly 6 in an extended position. That is to say, cap 8 abuts a ledge 14 on insert member 2A with stem 10 of plunger assembly 6 extending through the insert member so that plunger 12 engages frame member 4A which may include a hole, detent, flange, slot or other such means for that purpose. For purposes of illustration, a hole 16 is shown and described. It will be understood that with the arrangement described and a plurality of plunger assemblies disposed around the perimeter of frame 4, insert 2 is secured in frame 4, as is desirable.

With reference to FIG. 3, plunger 12 retracts from hole 16 when cap 8 is lifted so as to remove plunger 12 from hole 16 in frame member 4A, whereby insert member 2A may be removed from frame 4 when the caps on all of the plungers are so lifted.

The prior art plunger mechanism is illustrated in FIG. 4. Spring 18 is captured within insert member 2A between the top of plunger 12 and the bottom of an insert member surface 20. With this arrangement, when cap 8 is grasped by a user and manually lifted to remove plunger 12 from hole 16 in frame member 4A, spring 18 is compressed so that plunger 12 is urged into insert member 2A and out of engagement with hole 16 as particularly shown in FIG. 3. When the cap is released by the user, spring 18 expands so as to urge plunger 12 out of insert member 2A into hole 16, as particularly shown in FIG. 2. When all such caps 8 on the several plunger assemblies have been released, insert 2 is firmly secured to frame 4.

It will be understood that with a plurality of plunger assemblies 8 disposed around the perimeter of insert 2 so that the respective plungers engage corresponding holes 16 or other such means as aforenoted, disposed around the perimeter of frame 4, it is difficult to insure that all of the plungers 12 are in engagement with said means. That is to say, each plunger cap 8 needs to be manually displaced and then aligned with means such as hole 16 to insure that plunger 12 will be properly received by said means, after which the cap is released so that the plunger engages said means. This becomes a cumbersome task and hinders the interchangeability or replacement of screen and/or glass inserts 2 in frame 4, as will now be appreciated.

Figure 7:
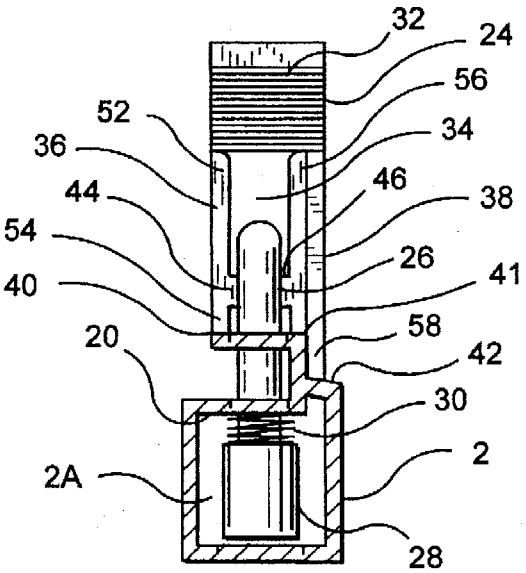
FIGS. 5–7 are diagrammatic representations illustrating the present invention for retaining glass/screen inserts in frames.
Figure 5:
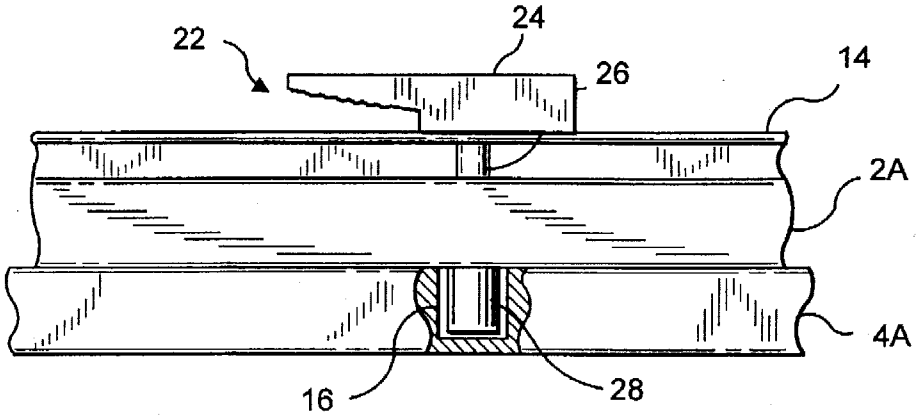
Figure 6:
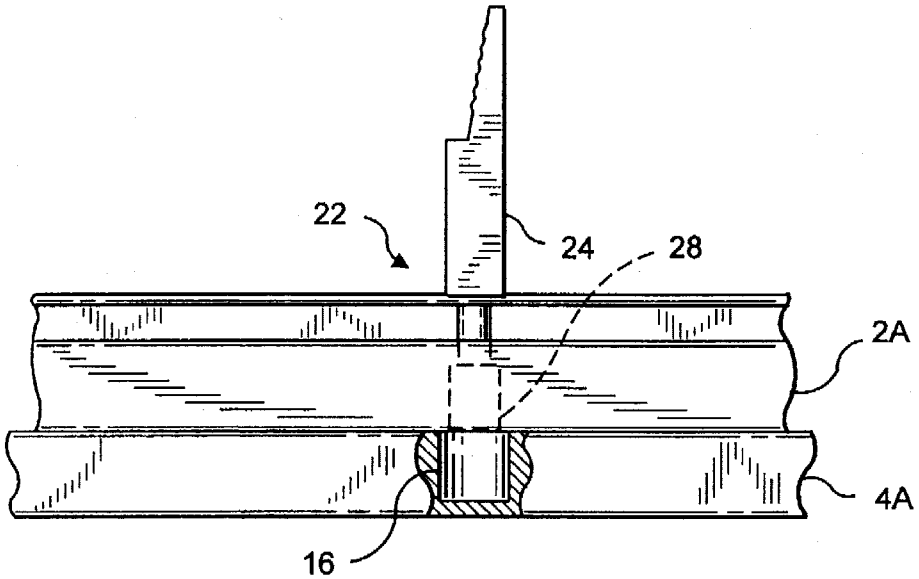

FIGS. 5–7, wherein elements common with those in FIGS. 1–3 carry common numerical designations, illustrate the present invention, whereby the disadvantages of the prior art as noted above are overcome.

Thus, with reference to FIG. 5, a plunger assembly 22 includes a cap 24 and an integral stem 26 and a plunger 28, and a spring 30 surrounding stem 26.

FIG. 5 shows plunger assembly 22 in an extended position. That is to say, cap 24 is substantially parallel to and abuts ledge 14 with stem 26 of plunger assembly 22 extending through insert member 2A so that plunger 28 is received in means such as hole 16 in frame member 4A. As referred to with regard to FIGS. 2–4, with a plurality of plunger assemblies disposed around the perimeter of frame 4, insert 2 is secured in the frame as is desirable.

With reference to FIG. 6, plunger 28 retracts from hole 16 when cap 8 is flipped to a position substantially normal to frame member 2A, whereby insert 2 may be removed from frame 4 when the caps on all of the plungers are so flipped.

The plunger mechanism of the present invention is illustrated in FIG. 7. Spring 30 is captured within insert member 2A between the top of plunger 28 and the bottom 0f insert member surface 20. With this arrangement, when cap 24 is flipped from the (horizontal) position shown in FIG. 5 to the (vertical) position shown in FIGS. 6 and 7, spring 30 is compressed so as to urge plunger 28 into insert 2 and out of engagement with means such as hole 16 of frame member 4A, as particularly shown in FIG. 6. The advantage of the invention as described is that when cap 24 is flipped as aforenoted, it remains in the flipped (vertical) position, thus freeing the hands of the user and facilitating interchanging or replacement of insert 2, as will now be discerned. When cap 24 is flipped to the position (horizontal) shown in FIG. 5, spring 30 expands so as to urge plunger 28 out of insert member 2A into frame member hole 16, as particularly shown in FIG. 5. When all such caps on the several plunger assemblies are in their respective frame holes, insert 2 is firmly secured to frame 4 and when all of the caps are flipped to the vertical position as shown in FIGS. 5 and 7, the insert is released from the frame.

With continued reference to FIG. 7, cap 24 includes a gripping portion 32 and an open channel 34 formed by a leg 36 with a proximal end 52 and a distal end 54; and another substantially parallel leg 38 having a distal end 58 and a proximal end 56. Leg 36 extends; downwardly so as to abut the top of an insert member or an outer surface 40 and leg 38 extends downwardly beyond leg 36 so as to abut the side surface 41 and the surface 42 of insert member 2A which are arranged in a step-shaped fashion.

Channel 34 includes guiding members 44 and 46 for guiding stem 26 within channel 34. Thus, the arrangement is such that when cap 24 is flipped to the vertical position shown in FIGS. 6 and 7, stem 26 disposed in channel 34 between guiding members 44 and 46 transfers the compression of spring 30 to cap 24 to position the cap. When cap 24 is flipped to the horizontal position, stem 26 disposed in the channel between the guide members transfers the expansion of spring 30 to change the position of cap 24.

The features of the invention described with regard to FIGS. 5, 6 and 7 overcome the disadvantages of the prior art to the extent that when the plungers are withdrawn from the frame member holes, they remain so withdrawn until cap 24 is flipped to the horizontal position to engage the holes. This greatly facilitates the alignment of the plungers with the corresponding holes and frees the hands of the user to facilitate engaging the insert plunger and frame holes, as will now be understood.

With the above description of the invention in mind, reference is made to the claims appended hereto for a definition of the scope of the invention.

What is claimed is:

1. An arrangement for retaining a glass or screen insert within a frame, wherein a plurality of plunger assemblies are disposed around a perimeter of the insert, each said plunger arrangement comprising:

a cap external to an insert member, the cap including a gripping portion, first and second legs extending outwardly from the gripping portion, a channel formed between the first and second legs, each said leg having a proximal end connected to the gripping portion and a distal end, said distal end of the second leg extending a further distance from the gripping portion than the distal end of the first leg;

a stem having one end received within said channel and other end;

a plunger carried by the other end of the stem;

a spring surrounding the stem and disposed within an insert member, the spring being captured between the plunger and an internal surface of the insert member for urging the plunger in and out of the insert member;

an exterior of the insert member having at least an outer surface and a side surface positioned at an angle to each other, the stem cooperating with the cap so that when the cap is in a first position relative to the insert member the spring is expanded to urge the plunger out of the insert member for engagement with a corresponding frame member, and the stem cooperating with the cap so that when the cap is in a second position relative to the insert member the spring is compressed to urge the plunger into the insert member for disengagement of said plunger from the corresponding frame member, whereby in the second position while the cap is normal to the insert the distal end of the first leg engages the outer surface and the distal end of the second leg engages the side surface of the insert member preventing expansion of the plunger out of the insert member and facilitating installation of the insert within the frame.

2. The arrangement as described by claim 1, wherein the cap includes:

an open channel;

a pair of guide members extending in the channel in opposing directions;

the one stem end being in engagement with the channel between the guide member for transferring the compression and expansion of the spring to the cap to change the position of the cap.

3. The arrangement of claim 1, further comprising the first and second leg being substantially parallel to each other, a first step-shaped portion formed at a junction of said distal ends of the first and second legs, a second step-shaped portion formed at a junction of said outer surface and side surface of the insert member wherein, in said second position said first step-shaped portion engages said second step-shaped portion.

4. The arrangement of claim 3, further comprising said distal end of the second leg formed with a substantially flat engaging portion and said side surface of the insert member being substantially flat wherein, in said second position said substantially flat engaging portion of the second leg engages said substantially flat side surface of the insert member preventing rotational motion of said cap about a longitudinal axis of the stem.

5. The arrangement of claim 1, wherein, in the first position, the cap is substantially parallel to the insert member and is in abutment therewith.

6. The arrangement of claim 1, wherein, in said second position, while the cap is normal to the insert, a longitudinal axis of the cap is substantially parallel to the longitudinal axis of the stem.

* * * * *